US007581537B1

(12) United States Patent
Yeh

(10) Patent No.: US 7,581,537 B1
(45) Date of Patent: Sep. 1, 2009

(54) PAINTBALL GUN WITH A PRESSURE GAUGE DEVICE

(75) Inventor: Hsin-cheng Yeh, Yung Kang (TW)

(73) Assignee: Sunworld Industrial co., Ltd., Tainan Hsien (TW)

( * ) Notice: Subject to any disclaimer, the term of this patent is extended or adjusted under 35 U.S.C. 154(b) by 0 days.

(21) Appl. No.: 12/153,382

(22) Filed: May 19, 2008

(30) Foreign Application Priority Data

Mar. 10, 2008 (TW) ..... 97204035 U

(51) Int. Cl.
*F41B 11/00* (2006.01)

(52) U.S. Cl. ..... 124/71; 124/56; 124/1; 124/80; 42/1.01

(58) Field of Classification Search ..... 124/71–77
See application file for complete search history.

(56) References Cited

U.S. PATENT DOCUMENTS 2,856,911 A * 10/1958 Boger ..... 124/71
3,662,729 A * 5/1972 Henderson ..... 124/73
3,680,540 A * 8/1972 Stengl ..... 124/73
3,739,764 A * 6/1973 Allport ..... 124/70
3,888,033 A * 6/1975 Fima ..... 43/6
4,004,567 A * 1/1977 Henderson ..... 124/61
4,046,056 A * 9/1977 Carrie ..... 89/12
4,148,245 A * 4/1979 Steffanus et al. ..... 89/7
4,712,537 A * 12/1987 Pender ..... 124/76
4,784,107 A * 11/1988 Kelly ..... 124/61
5,103,366 A * 4/1992 Battochi ..... 89/1.11
5,265,582 A * 11/1993 Bhogal ..... 124/73
5,496,025 A * 3/1996 Phillips et al. ..... 124/56
5,974,611 A * 11/1999 Casella ..... 124/56
6,276,353 B1 * 8/2001 Briggs et al. ..... 124/71
6,405,722 B2 * 6/2002 Colby ..... 124/74
6,543,475 B2 * 4/2003 Colby ..... 124/74
6,729,322 B2 * 5/2004 Schavone ..... 124/72
6,874,492 B1 * 4/2005 Schavone ..... 124/73
2001/0050076 A1 * 12/2001 Colby ..... 124/74
2003/0034021 A1 * 2/2003 Gabrel ..... 124/71
2003/0056778 A1 * 3/2003 Schavone ..... 124/74
2003/0101979 A1 * 6/2003 Schavone ..... 124/74
2003/0106545 A1 * 6/2003 Verini ..... 124/74
2003/0127085 A1 * 7/2003 Brunette et al. ..... 124/74
2004/0074486 A1 * 4/2004 Schavone ..... 124/56
2007/0235015 A1 * 10/2007 Pravata ..... 124/71
2008/0210210 A1 * 9/2008 Colby ..... 124/73

* cited by examiner

*Primary Examiner*—Troy Chambers
*Assistant Examiner*—Jonathan C Weber
(74) *Attorney, Agent, or Firm*—Rosenberg, Klein & Lee

(57) ABSTRACT

A paintball gun with a pressure gauge device includes a rear cap, a pressure gauge, and a canopy. The rear cap has a first end and a second end. The rear cap has a compartment at the first end adapted to accommodate the pressure gauge. The second end of the rear cap has a piston block. The piston block has an air passage interconnecting with an air passage of the pressure gauge. The canopy is fixed to the rear cap which is then secured to a rear end of a barrel in the paintball gun. A triggering block is provided in the barrel. The triggering block engages with the rear cap. This design allows the user to read the air pressure within the paintball gun so that the user may apply air pressure to the paintball gun when necessary.

8 Claims, 6 Drawing Sheets

A

PAINTBALL GUN WITH A PRESSURE GAUGE DEVICE

BACKGROUND OF THE INVENTION

1. Field of the Invention

The present invention relates to a paintball gun with a pressure gauge device, and more particularly to a pressure gauge mounted behind a triggering block in a barrel of the paintball gun so that the user may constantly understand the air pressure in the paintball gun to supply air when necessary.

2. Description of the Prior Art

Air pressure is a major part for a paintball gun to shoot a paint bullet. In order to know the air pressure in the paintball gun, a conventional paintball gun only measures the air pressure of an air cylinder. Another conventional paintball gun is to mount a pressure gauge to the handle or the front of the paintball gun, and then is sealed with glue to prevent leakage. However, the mounting of the pressure gauge may hinder the user to grasp the handle, and is unable to mount or dismount quickly.

A later design was delivered as shown in FIG. 6, which comprises a fixing tube A, a switch rod B, a pushing rod C, a swivel tube D, and a pressure gauge E. The fixing tube A is connected to a barrel. The barrel is provided with an air passage F and a one-way valve G at one side of the barrel. The fixing tube A interconnects with the air passage F. The pushing rod C is located in the fixing tube A and corresponds in position to the one-way valve G. The switch rod B is mounted to the fixing tube A and engages with the pushing rod C to push the one-way valve G to interconnect with the air passage F. The swivel tube D is connected with the pressure gauge E and fits onto the fixing tube A. The swivel tube D and the fixing tube A are interconnected with each other. The pressure gauge E is adapted to measure the air pressure in the air passage F.

Although this design has solved the above-mentioned problems, it still has some shortcomings such as:

1. The air pressure device has to be purchased separately, which increases the cost.

2. The pressure gauge bulges out of the paintball gun, which may interrupt the user.

3. The pressure gauge is far away from the user, which is not easy to read.

SUMMARY OF THE INVENTION

According to the present invention, there is provided a paintball gun with a pressure gauge device comprising:

a rear cap having a first end and a second end, said first end being formed with a compartment, said second end being provided with a piston block, a first air sealing ring being provided on said piston block, a second air sealing ring being provided on said rear cap, a first air passage being formed between said first air sealing ring and said second air sealing ring;

a pressure gauge accommodated in said compartment of said rear cap and comprising a guiding rod, two sealing rings being provided on said guiding rod, a second air passage being formed between said two sealing rings, said second air passage interconnecting with said first air passage; and a barrel comprising a triggering block therein, said barrel having a rear end to connect with said rear cap, said triggering block engaging with said rear cap, said triggering block having a third air passage at a rear end thereof, said third air passage interconnecting with said first air passage.

Preferably, said rear cap further comprises a canopy, said canopy being fixed to said rear cap.

Preferably, an air room is formed between said triggering block and said barrel, said air room interconnecting with said third air passage of said triggering block.

Preferably, a buffering ring is provided on said rear cap for sealing with said triggering block.

Preferably, said pressure gauge has an engaging groove for connection of a lid.

Preferably, said lid has a first through hole.

Preferably, said canopy has a second through hole corresponding to said first through hole of said lid of said pressure gauge.

Preferably, said canopy is in a taper shape.

It is the primary object of the present invention to provide a paintball gun with a pressure gauge device, which is easy to read the air pressure in the paintball gun.

It is another object of the present invention to provide a paintball gun with a pressure gauge device, which provides a pressure gauge installed on the paintball gun directly without any other requirement for reading the air pressure in the paintball gun.

It is a further object of the present invention to provide a paintball gun with a pressure gauge device, which is located at the rear of the paintball gun to facilitate the user to read the air pressure.

DETAILED DESCRIPTION OF THE PREFERRED EMBODIMENT

Figure 1:
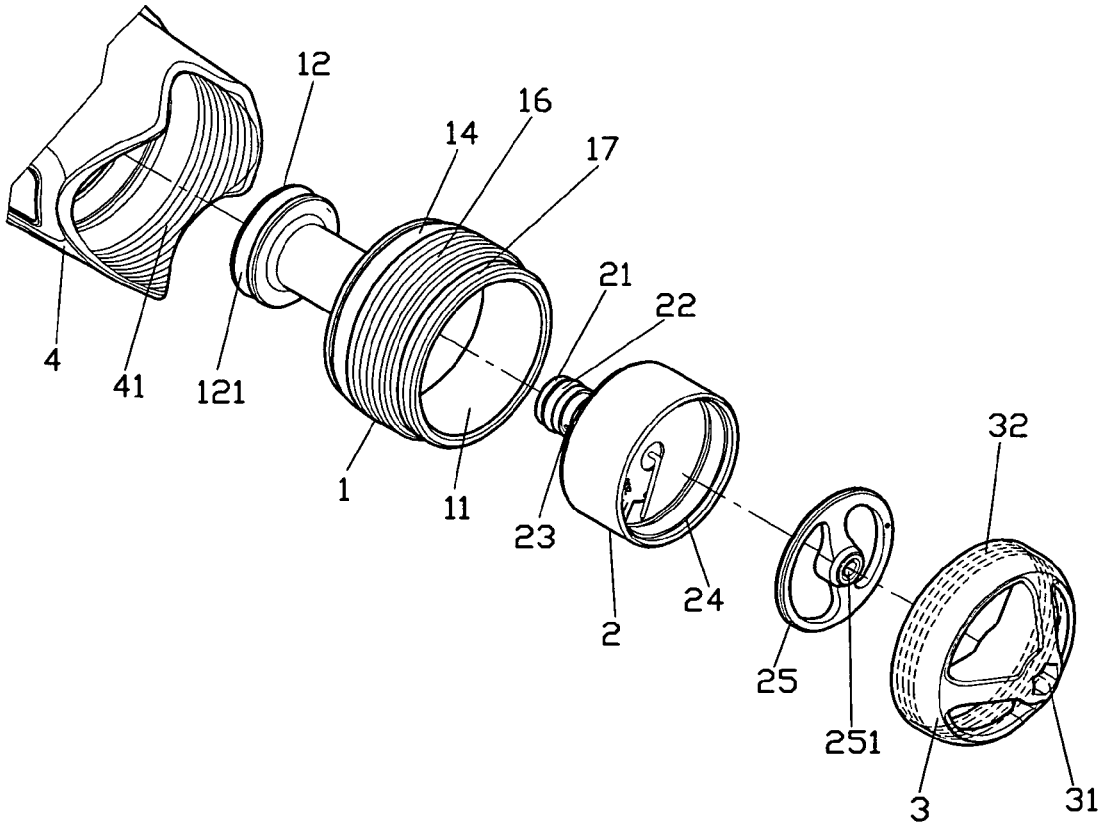
FIG. 1 is an exploded view of the present invention.
Figure 2:
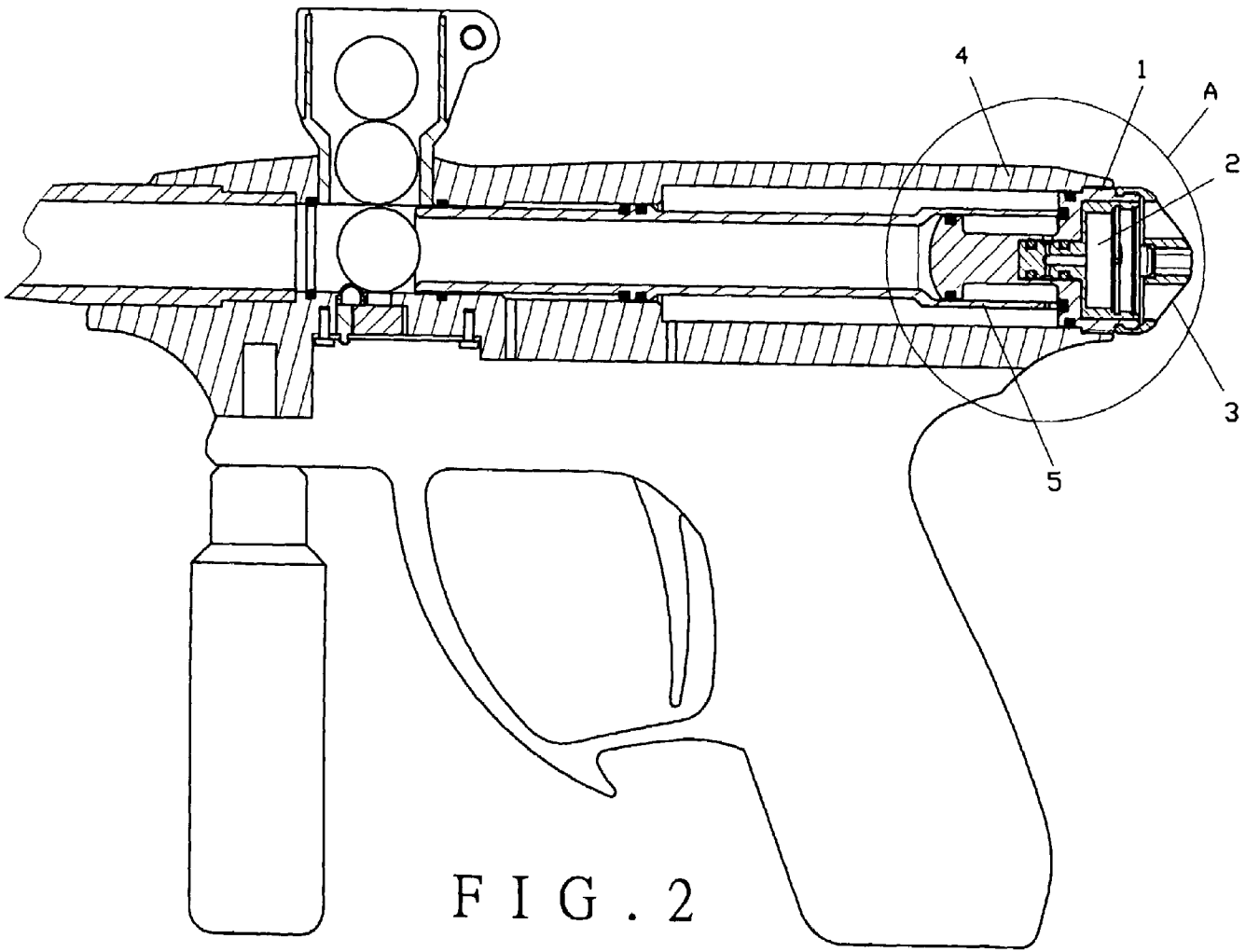
FIG. 2 is a cross-sectional view of the present invention.

As shown in FIGS. 1 and 2, a preferred embodiment of the present invention comprises a rear cap 1, a pressure gauge 2, a canopy 3, a barrel 4 and a triggering block 5.

Figure 3:
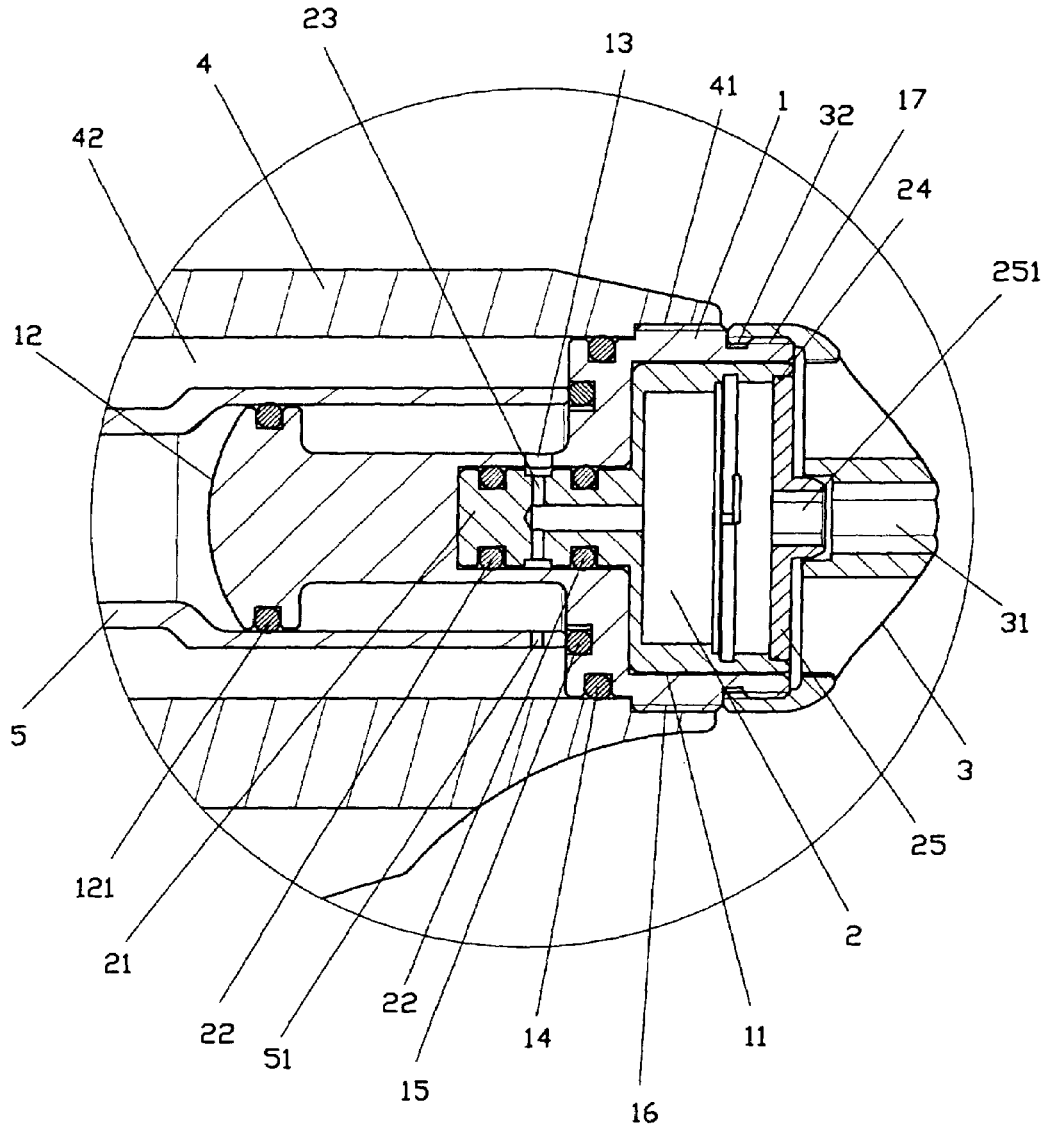
FIG. 3 is an enlarged view of FIG. 2.

The rear cap 1 has a first end and a second end. The first end is formed with a compartment 11 adapted to receive the pressure gauge 2. The second end is provided with a piston block 12. A first air sealing ring 121 is provided on the piston block 12. A second air sealing ring 14 is provided on the rear cap 1. A first air passage 13 is formed between the first air sealing ring 121 and the second air sealing ring 14, as shown in FIG. 3. The rear cap 1 further comprises a buffering ring 15 corresponding to the triggering block 5 to buffer the back fire of the triggering block 5. A first threaded section 16 and a second threaded section 17 are provided on the rear cap 1. The first threaded section 16 is for the connection of the barrel 4, while the second threaded section 17 is for the connection of the canopy 3.

The pressure gauge 2 has a first end and a second end. A guiding rod 21 is provided at the first end of the pressure gauge 2. Two sealing rings 22 are provided on the guiding rod 21. A second air passage 23 is formed between the two sealing rings 22. The pressure gauge 2 is formed with an engaging groove 24 around an inner edge of the second end of the pressure gauge 2 for a lid 25 to be secured thereat. The lid 25 has a first through hole 251 at a center portion of the lid 25.

The canopy 3 is in a taper shape and has a threaded hole 32 corresponding to the second threaded section 17 of the rear cap 1 for connection purpose. The canopy 3 further has a second through hole 31 at a center portion of the canopy 3, corresponding to the first through hole 251 of the lid 25 of the pressure gauge 2.

The barrel 4 is formed with a third threaded section 41 at a rear end thereof adapted to connect with the rear cap 1. The triggering block 5 is located in the barrel 4. The triggering block 5 engages with the rear cap 1. An air room 42 is formed between the barrel 4 and the triggering block 5.

The triggering block 5 has a third air passage 51 at a rear end thereof. The third air passage 51 interconnects with the first air passage 13 of the rear cap 1.

To assemble the present invention, as shown in FIGS. 2 and 3, the guiding rod 21 of the pressure gauge 2 is inserted into the compartment 11 of the rear cap 1. The canopy 3 is screwed to the second thread section 17. The rear cap 1 is connected to the rear end of the barrel 4. The triggering block 5 in the barrel 4 engages with the rear cap 1. The second air passage 23 of the pressure gauge 2, the first air passage 13 of the rear cap 1, the third air passage 51 of the triggering block 5, and the air room 42 formed between the barrel 4 and the triggering block 5 are interconnected.

Figure 4:
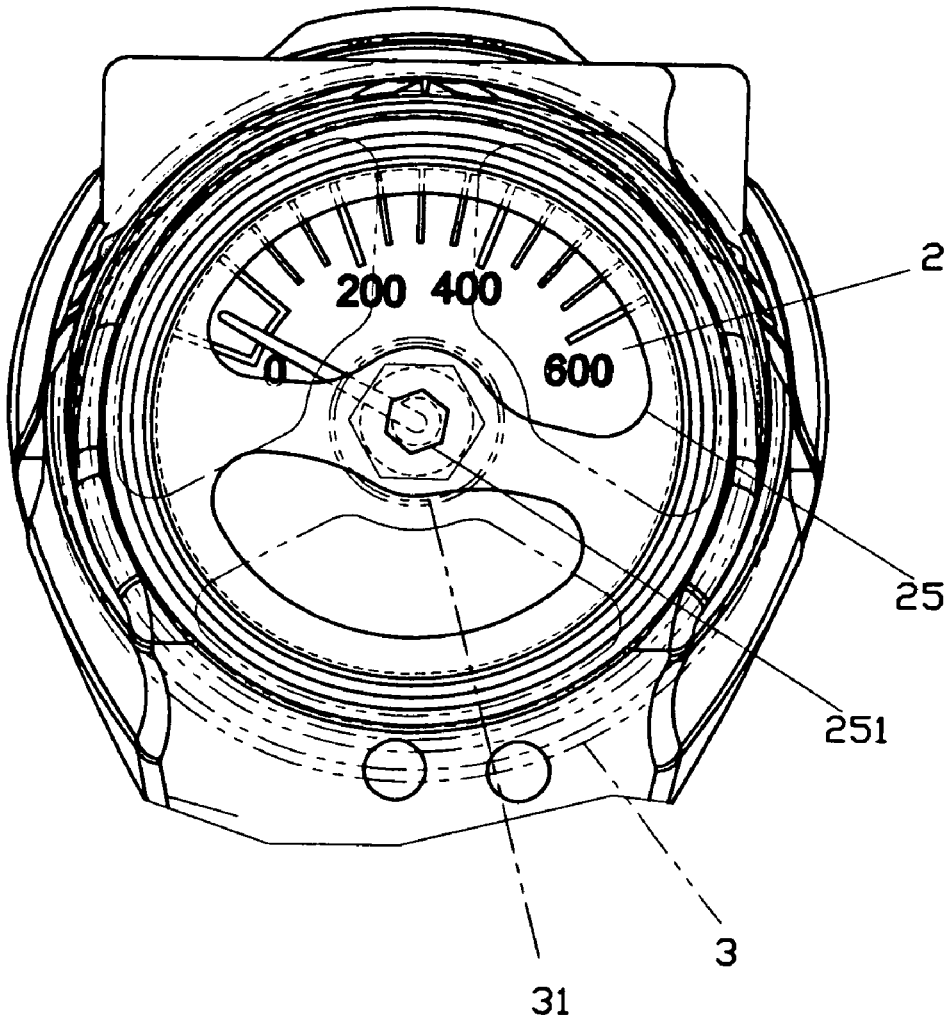
FIG. 4 is a rear view of the present invention.
Figure 5:
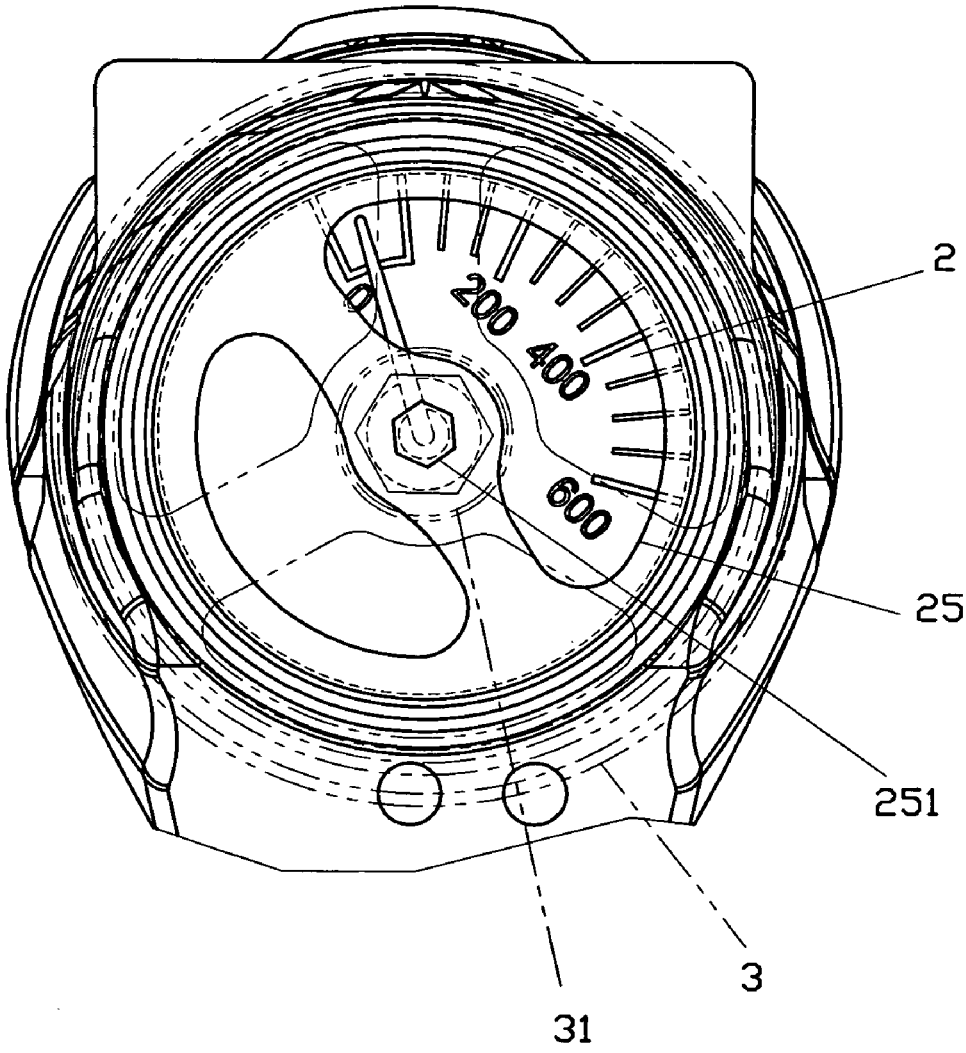
FIG. 5 is the rear view of the present invention in operation.
Figure 6:
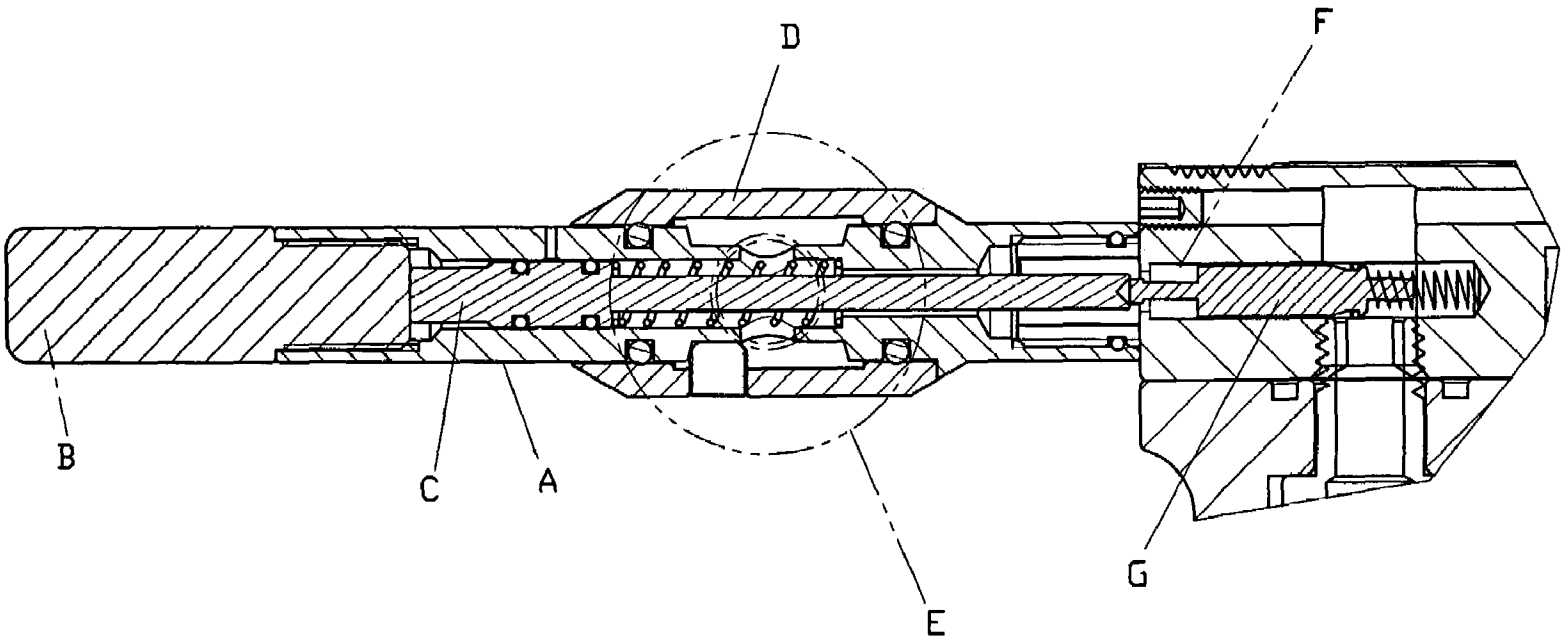
FIG. 6 (PRIOR ART)
FIG. 6 is a side cross-sectional of the prior art.

To turn the pressure gauge 2 towards a different direction, as shown in FIGS. 4 and 5, a tool is inserted through the second through hole 31 of the canopy 3 and the first through hole 251 of the lid 25 to turn the pressure gauge 2 in a desired direction.

Furthermore, the canopy 3 may be welded or glued to the rear cap 1 after being screwed together with the second threaded section 17 of the rear cap 1, so that when it is necessary to disassemble the present invention, the canopy 3 will be rotated to loosen the rear cap 1 at the same time.

What is claimed is:

1. A paintball gun with a pressure gauge device comprising:

a rear cap having a first end and a second end, said first end being formed with a compartment, said second end being provided with a piston block, a first air sealing ring being provided on said piston block, a second air sealing ring being provided on said rear cap, a first air passage being formed between said first air sealing ring and said second air sealing ring;

a pressure gauge accommodated in said compartment of said rear cap and comprising a guiding rod, two sealing rings being provided on said guiding rod, a second air passage being formed between said two sealing rings, said second air passage interconnecting with said first air passage; and a barrel comprising a triggering block therein, said barrel having a rear end to connect with said rear cap, said triggering block engaging with said rear cap, said triggering block having a third air passage at a rear end thereof, said third air passage interconnecting with said first air passage.

2. The paintball gun with a pressure gauge device, as recited in claim 1, wherein said rear cap further comprises a canopy, said canopy being fixed to said rear cap.

3. The paintball gun with a pressure gauge device, as recited in claim 1, wherein an air room is formed between said triggering block and said barrel, said air room interconnecting with said third air passage of said triggering block.

4. The paintball gun with a pressure gauge device, as recited in claim 1, wherein a buffering ring is provided on said rear cap for sealing with said triggering block.

5. The paintball gun with a pressure gauge device, as recited in claim 1, wherein said pressure gauge has an engaging groove for connection of a lid.

6. The paintball gun with a pressure gauge device, as recited in claim 5, wherein said lid has a first through hole.

7. The paintball gun with a pressure gauge device, as recited in claim 6, wherein said canopy has a second through hole corresponding to said first through hole of said lid of said pressure gauge.

8. The paintball gun with a pressure gauge device, as recited in claim 1, wherein said canopy is in a taper shape.

* * * * *